US007954475B2

(12) United States Patent
Eisenmenger et al.

(10) Patent No.: US 7,954,475 B2
(45) Date of Patent: Jun. 7, 2011

(54) FUEL INJECTOR

(75) Inventors: Nadja Eisenmenger, Stuttgart (DE); Michael Mennicken, Wimsheim (DE); Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 45 days.

(21) Appl. No.: 12/303,402

(22) PCT Filed: Apr. 25, 2007

(86) PCT No.: PCT/EP2007/054064

§ 371 (c)(1),
(2), (4) Date: Dec. 4, 2008

(87) PCT Pub. No.: WO2007/144226

PCT Pub. Date: Dec. 21, 2007

(65) Prior Publication Data

US 2009/0266340 A1 Oct. 29, 2009

(30) Foreign Application Priority Data

Jun. 13, 2006 (DE) ..... 10 2006 027 330

(51) Int. Cl.
*F02M 41/00* (2006.01)

(52) U.S. Cl. ..... 123/490; 123/446; 239/585.1

(58) Field of Classification Search ..... 123/490, 123/491, 446, 457, 467, 506; 239/585.1, 239/96, 88, 89, 533.2, 533.8, 533.9
See application file for complete search history.

(56) References Cited

U.S. PATENT DOCUMENTS

| | | | | |
|---|---|---|---|---|
| 4,182,492 | A * | 1/1980 | Albert et al. | 239/92 |
| 4,462,368 | A * | 7/1984 | Funada | 123/446 |
| 6,367,453 | B1 | 4/2002 | Igashira et al. | |
| 6,725,841 | B1 | 4/2004 | Boecking | |
| 6,805,101 | B2 * | 10/2004 | Magel | 123/467 |
| 6,886,535 | B2 * | 5/2005 | Boehland | 123/446 |
| 6,892,955 | B2 * | 5/2005 | Grabandt | 239/88 |
| 6,895,940 | B2 | 5/2005 | Igashira | |
| 6,896,208 | B2 * | 5/2005 | Kuegler | 239/533.4 |
| 2002/0117149 | A1 | 8/2002 | Igashira et al. | |
| 2006/0043210 | A1 | 3/2006 | Boecking | |

FOREIGN PATENT DOCUMENTS

| | | | |
|---|---|---|---|
| DE | 19949528 | A1 | 4/2001 |
| DE | 10055714 | A1 | 6/2001 |
| DE | 10325620 | A1 | 10/2004 |
| DE | 102004015744 | A1 | 10/2005 |
| DE | 102004035455 | A1 | 2/2006 |
| WO | 03004857 | A1 | 1/2003 |
| WO | 2004048769 | A1 | 6/2004 |

* cited by examiner

*Primary Examiner* — John T Kwon
(74) *Attorney, Agent, or Firm* — Ronald E. Greigg

(57) ABSTRACT

A fuel injector for injecting fuel into a combustion chamber of an internal combustion engine. A fuel supply line enters an injector housing from a high-pressure fuel source which can be hydraulically connected to a pressure chamber. A 3/2 directional control valve for injecting fuel into the combustion chamber has a valve piston which can be moved axially back and forth between a rest position and an injection position. The 3/2 directional control valve, by a first end face of the valve piston, is hydraulically coupled to and can be activated by a piezoelectric actuator. The 3/2 directional control has a ball element which is connected to a second end face of the valve piston and, in the rest position, can be moved against a first sealing edge and, in the injection position, can be moved against a second sealing edge.

18 Claims, 2 Drawing Sheets

FUEL INJECTOR

CROSS-REFERENCE TO RELATED APPLICATION

This application is a 35 USC 371 application of PCT/EP 2007/054064 filed on Apr. 25, 2007.

BACKGROUND OF THE INVENTION

1. Field of the Invention

The present invention relates to a fuel injector in particular used in an internal combustion engine, that enables the metered injection of the fuel to be combusted.

2. Description of the Prior Art

DE 103 25 620 A1 has disclosed a servo valve-controlled fuel injector with a pressure booster. The fuel injector disclosed therein includes a pressure booster, whose booster piston divides a working chamber, which is acted on with fuel by means of a pressure accumulator, from a differential pressure chamber, which can be pressure-relieved. A pressure change in the differential pressure chamber occurs through an actuation of the servo valve, which opens or closes a hydraulic connection of the differential pressure chamber to a first low-pressure side return. The servo valve also has a servo valve piston guided between a control chamber and a first hydraulic chamber. This servo valve piston has a hydraulic surface, which continuously acts on the servo valve piston in the opening direction when it is acted on by system pressure, and a first sealing seat that closes or opens a low-pressure side return. Activation of the pressure booster, however, requires a switching valve that activates a servo valve piston, which requires a significant structural complexity. In addition, aforementioned piezoelectric actuators can be used in order to circumvent the requirement for a switching valve.

DE 10 2004 015 744 A1 has disclosed a fuel injector of this generic type for the injection of fuel into a combustion chamber of an internal combustion engine, having an injector housing that has a fuel inlet, which is connected to a central high-pressure fuel source outside of the injector housing and is connected to a pressure chamber inside the injector housing, from which highly pressurized fuel is injected as a function of the position of the control valve, in particular a 3/2-way directional control valve. In this case, the 3/2-way directional control valve is provided with a valve piston, which is hydraulically coupled to the piezoelectric actuator and can be acted on with the pressure from the high-pressure fuel source. The valve piston in this case is situated in a valve control chamber and produces a seal against sealing edges that are situated in the sealing control chamber itself.

In the known embodiments of fuel injectors of interest here, the problem arises that the 3/2-way directional control valve and in particular, the axially movable valve piston contained therein, must be embodied in a complex fashion, which results in a significant production cost. For the correspondingly precise embodiment of the valve piston, complex matching grinding processes of the sealing seat are required, it being necessary for these sealing seats to be produced concentrically to each other in the valve body itself.

OBJECT AND SUMMARY OF THE INVENTION

The object of the present invention, therefore, is to create a fuel injector with a 3/2-way directional control valve, which has a simple embodiment, thus eliminating complex production processes.

The invention includes the technical teaching that the 3/2-way directional control valve includes a ball element serving as a valve member, which is attached to a second end surface of the valve piston and can be moved against a first sealing edge in the neutral position and can be moved against a second sealing edge in the injection position; in order to achieve a pressure-balanced switching, the first end surface of the valve piston and the partial surface on the ball element situated opposite from it, which is delimited by the second sealing edge, have effective areas of approximately the same size exposed to the pressure from the high-pressure fuel source.

This design offers the advantage of that the valve piston can be simply embodied in the form of a simple cylindrical component, with the sealing seats of the 3/2-way directional control valve being embodied by of the ball element. This consequently eliminates a complex grinding machining of the valve piston and in addition, the valve piston does not have to be fitted into the valve body or ground in a matching grinding process. The ball element here is accommodated in the valve control chamber and is able to move freely therein. This results in an automatic centering of the ball in the sealing seats since the latter are embodied in annular fashion and the ball element is moved merely by the fluidic pressure of the fluid or by the valve piston itself. The ball element here is preferably situated so that adjoins the valve piston, a simple solid contact being sufficient to achieve this; however, it is also possible for the ball to be connected to the valve piston by any joining method. The diameter of the valve piston and the diameter at the first sealing edge preferably have a ratio that permits the ball element to be pressed against the first sealing edge with a slight contact pressure in the neutral position. This diameter ratio by which the ball element is pressed only slightly against the sealing seat with the prevailing pressure conditions enables the use of a small piezoelectric actuator, despite the fact that a very high system pressure prevails in the high-pressure fuel accumulator.

According to another advantageous embodiment of the present invention, the ball element is contained in the valve control chamber and the sealing edges are embodied in the contour of the valve control chamber. Only with the sealing edges being situated inside the valve control chamber can the ball element move back and forth between a first sealing edge and a second sealing edge. In this instance, the ball element is able to automatically center itself both in the first annular sealing edge and in the second annular sealing edge for the respective neutral position and injection position of the fuel of the injection valve, thus assuring a reliable sealing action.

Advantageously, the valve control chamber has a radially symmetrical inner contour so that the ball element produces an annular sealing contact against the respective sealing edges. As in the above-mentioned prior art, the valve body has first and second sealing edges that are formed onto the inside of the valve body in the form of stepped circular bores. However, the same quality of concentricity of the individual sealing edges is not required since the ball moves freely and automatically centers itself in the rotationally symmetrical, i.e. annular shoulder of the sealing edge.

According to another embodiment of the present invention, the valve control is acted on by the pressure from the high-pressure fuel source when the ball element seals against the first sealing edge in the neutral position, whereas the valve control chamber can be pressure-relieved in the direction of a return conduit when the ball element seals against the second sealing seat in the injection position. In the neutral position of the valve piston, the injector is not activated, i.e. no injection takes place. In the injection position of the valve piston, highly pressurized fuel is injected from the fuel injector into the combustion chamber of an internal combustion engine. The diameter of the valve piston is advantageously smaller than the diameter of the first sealing edge. As a result, in the neutral position of the valve piston, a slight hydraulic force of pressure of the ball into the seat of the first sealing edge is produced, which assures a sealed contact of the first sealing edge with the ball element.

According to another advantageous embodiment, the diameter of the second sealing edge is smaller than the diameter of the valve piston. As a result, in the injection position of the valve piston, a slight hydraulic force of pressure is produced, which assures a sealed contact of the second sealing edge with the ball.

In order to produce a simple structural embodiment of the valve piston, the geometrical shape of the valve piston is embodied in the form of cylindrical base body or has a cylindrical base body section with a stepped, cylindrical end section that has a smaller diameter. The ball element advantageously includes a metallic or ceramic material and/or is embodied in the form of a standard roller bearing element.

The valve control chamber advantageously communicates with a pressure booster control chamber. The pressure booster control chamber serves to control the pressure booster piston that can be accommodated so that it is able to move back and forth in the injector housing. In addition, the valve control chamber can communicate with a nozzle needle control chamber. When the pressure in the valve control chamber is decreased by the 3/2-way directional control valve, then the tip of the nozzle needle lifts away from its seat and fuel can be injected through the injection ports into the combustion chamber of the internal combustion engine.

According to another advantageous embodiment, the injector housing includes a hydraulic coupling chamber that is acted on with the pressure of the high-pressure fuel source and hydraulically couples the piezoelectric actuator to the first end surface of the valve piston. The piezoelectric actuator can, for example, have an essentially circular, cylindrical head composed of metal attached to it, whose end surface delimits the hydraulic coupling chamber. On the opposite side, the hydraulic coupling chamber is preferably delimited by a first end surface of the valve piston. The hydraulic coupling chamber serves to compensate for volume expansions of the piezoelectric actuator due to temperature fluctuations during operation. It is thus also possible to implement a force/path boosting between the piezoelectric actuator and the valve piston.

The valve piston advantageously has an annular groove that can be acted on with the pressure of the high-pressure fuel source, thus making it possible to prevent a discharge of fluid from the coupling chamber. The annular groove also achieves a lubrication of the valve piston in the valve body, which optimizes at least the tribological behavior during the axial movement of the valve piston.

According to another embodiment of the invention, the piezoelectric actuator has electrical connections that are embodied in the form of external contacts in order to protect them from the fuel in the piezoelectric chamber. In addition, the piezoelectric actuator has a coating, at least outside the region of the electrical connections, which protects the contact layers of the piezoelectric actuator from the surroundings, in particular from the fuel in the piezoelectric actuator chamber. This therefore assures that the electrical contacts of the piezoelectric actuator are insulated from the filet in order to counteract a possible fire hazard.

BRIEF DESCRIPTION OF THE DRAWINGS

Other steps that improve the invention, together with the description of preferred exemplary embodiments of the invention, will be explained in greater detail below in conjunction with the drawings, in which.

DESCRIPTION OF THE PREFERRED EMBODIMENTS

Figure 1:
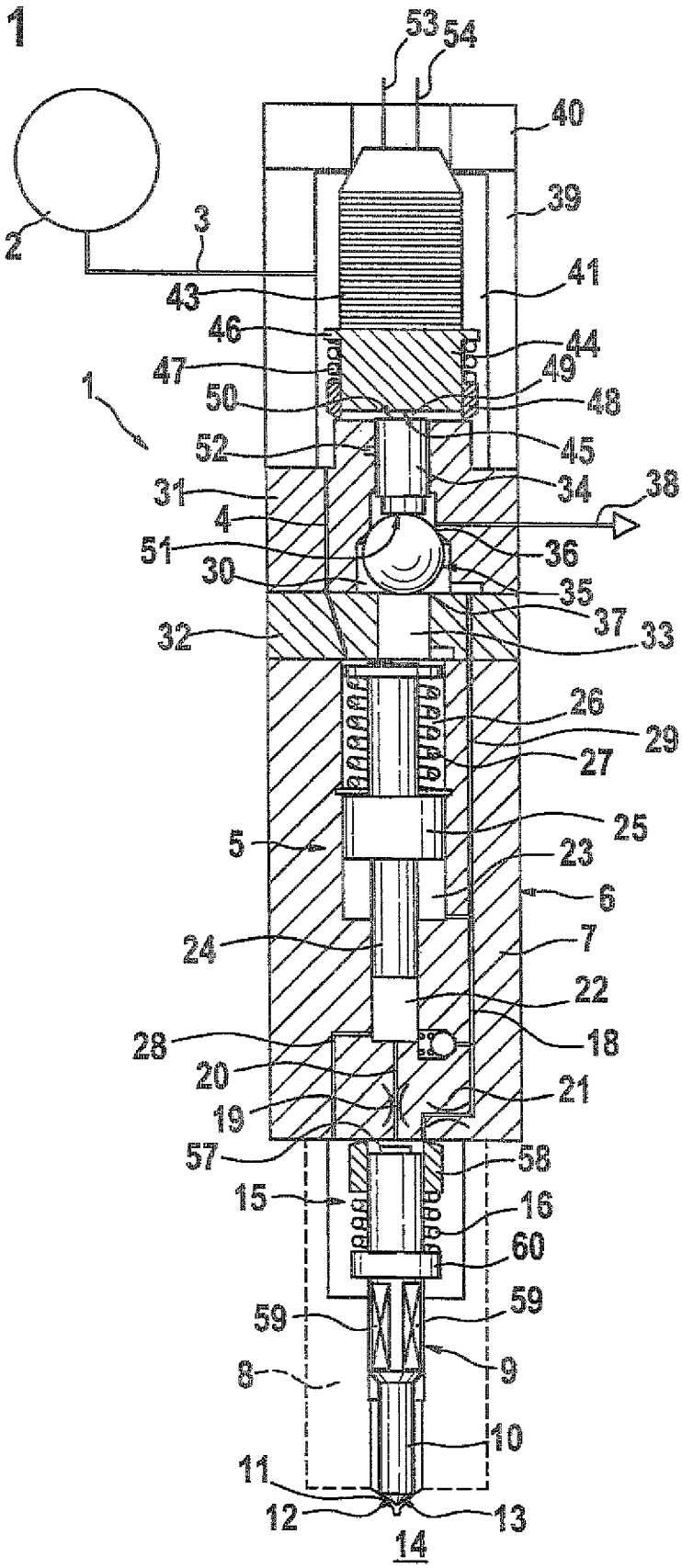
FIG. 1 shows a first exemplary embodiment of a fuel injector with a 3/2-way directional control valve, which has a ball element as a sealing body, in which the device includes a pressure booster

FIG. 1 shows a longitudinal section through a fuel injector 1 that is supplied with highly pressurized fuel by a schematically depicted high-pressure source 2 (common rail). From the inner chamber of the high-pressure source 2, a fuel line 3, 4 extends to a pressure booster 5, which is integrated into the fuel injector 1. The pressure booster 5 is enclosed by an injector housing 6. The injector housing 6 includes an injector body 7 and a nozzle body 8 that has a central guide bore 9. A nozzle needle 10 is contained so that it is able to move back and forth in the guide bore 9. The nozzle needle has a tip 11 on which a sealing surface is embodied, which cooperates with a sealing seat. When the tip 11 of the nozzle needle 10 rests with its sealing surface in contact with the sealing seat, this closes a plurality of injection ports 12, 13 that are provided in the nozzle body 8. When the nozzle needle tip 11 is moved away from its seat, highly pressurized fuel is injected through the injection ports 12, 13 into the combustion chamber of the internal combustion engine.

The nozzle body 8 includes a pressure chamber 15 and the nozzle needle 10 has a pressure shoulder embodied on it, which is situated in the pressure chamber 15. A nozzle spring 16 prestresses the nozzle needle 10 with its tip 11 against the associated nozzle needle seat. The nozzle spring 16 itself is situated in the pressure chamber 15, which is connected to a connecting conduit 18 with a throttle 21 built into it and communicates with a pressure booster control chamber 23. In addition, the pressure chamber 15 communicates with a pressure booster chamber 22 via a connecting conduit 20 in which a throttle 19 is provided.

A piston extension 24 that is embodied at the end of a pressure booster piston 25 is contained in the pressure booster chamber 22 in a fashion that permits it to move back and forth therein. The pressure booster chamber 22 is itself embodied in the injector body 7 so that the pressure booster piston 25 is contained in the injector body 7. This piston extension 24 is embodied in the form of a circular cylinder that has a smaller diameter than the adjoining part of the pressure booster piston 25. The other end of the pressure booster piston protrudes into a pressure booster working chamber 26 that communicates with the high-pressure fuel source 2 via the fuel inlet line 3, 4.

A pressure booster spring 27 is situated in the pressure booster working chamber 26 and prestresses the pressure booster piston 25 in the direction away from the nozzle needle 10.

The pressure booster chamber 22 communicates with the pressure chamber 15 via a connecting conduit 28. The pressure booster chamber 22 in turn communicates with the valve control chamber 30 contained in a valve body 31 via a connecting conduit 29. For production engineering reasons, an intermediate piece 32, which has a central connecting conduit 33 let into it, is situated between the valve body 31 and the injector body 7. The connecting conduit 33 produces a connection between the pressure booster working chamber 26 and the valve control chamber 30.

The valve control chamber 30 has a larger diameter than the section of the bore oriented away from the intermediate piece 32. The central bore of the valve body 31 accommodates a valve piston 34 in a longitudinally movable fashion. Adjacent to the valve piston 34, a ball element 35 is inserted into the valve control chamber 30 and can be brought into sealed contact against a first sealing edge 36 and a second sealing edge 37. If the valve control chamber is acted on with pressure from the high-pressure fuel source, then this occurs in a neutral position of the ball element 35 in which the latter produces a seal against the first sealing edge 36, whereas when the ball element 35 produces a seal against the second sealing edge 37 in the injection position, the valve control chamber 30 can be pressure-relieved via a return conduit 38. Between the valve piston and the first sealing edge 36, a return conduit 38 is provided, which communicates with a fuel tank (not shown).

A piezoelectric actuator body 39 that is closed by a cover 40 is situated at the end of the valve body 31. The cover 40, the piezoelectric actuator body 39, the valve body 31, the intermediate piece 32, the injector body 7, and the nozzle body 8 together constitute the housing 6 of the injector. The piezoelectric actuator body 39 contains a central piezoelectric actuator chamber 41, which communicates via a connecting conduit with the fuel inlet line 3 and therefore with the high-pressure source 2. The piezoelectric actuator chamber 41, which is acted on with high pressure, contains a piezoelectric actuator 43 that has a piezoelectric actuator head 44 composed of metal with a free end surface 45. A collar 46 is embodied on the piezoelectric actuator head 44. A piezoelectric actuator spring 47 is clamped between the collar 46 and a piezoelectric actuator sleeve 48. The piezoelectric actuator head 44 can be slid in the axial direction in relation to the piezoelectric actuator sleeve 48. The piezoelectric actuator sleeve 48 is provided with a sealing edge that rests against the valve body 31. Inside the piezoelectric actuator sleeve 48, between the end surface 45 of the piezoelectric actuator head 44 and the free end surface of the valve piston 34, there is a hydraulic coupling chamber 49 that is acted on by high pressure from the high-pressure source 2.

In FIG. 1, the fuel injector 1 is shown in a deactivated state. The valve piston 34 is situated in its neutral position. Consequently, the ball element 35 rests against the first sealing edge 36, which is embodied in the valve body 31. In this position, the high pressure from the high-pressure source 2 prevails in the hydraulic coupling chamber 49. The valve control chamber 30 is likewise acted on with rail pressure from the high-pressure source 2 via the fuel inlet lines 3, 4, the pressure booster working chamber 26, and the connecting conduit 33. The pressure booster control chamber 23 is likewise acted on with rail pressure via the connecting conduit 29. The rail pressure thereby also prevails in the pressure booster chamber 22 and the pressure chamber 15.

If the fuel injection device 1 is now activated, the piezoelectric actuator 43 is supplied with power via the electrical connections 53, 54 and expands. The expansion of the piezoelectric actuator 43 causes the piezoelectric actuator head 44 to produce a pressure increase in the hydraulic coupling chamber 49. This pressure increase leads to an axial movement of the valve piston 34 downward, i.e. also causing the valve element 35 to move downward. The valve piston 34 and the valve element 35 here move downward until the valve element 35 comes into contact with the sealing edge 37 on the intermediate piece 32 and interrupts the communication between the connecting conduit 33 and the valve control chamber 30. At the same time, the ball element 35 lifts away from the first sealing edge 36 of the sealing seat and opens a connection to the valve control chamber 30 and the return line 38. The valve piston 34 and the ball element 35 are thus situated in the injection position. The valve control chamber 30 is pressure-relieved because of the connection with the return conduit 38.

The pressure booster chamber 22 is also pressure-relieved via the connecting conduit 29 between it and the valve control chamber 30. Since in this state, the pressure booster working chamber 26 is also acted on by the high-pressure source 2 via the fuel lines 3, 4, the pressure booster piston 25 moves downward, thus compressing the fuel in the pressure booster chamber 22. This pressure increase also acts on the pressure chamber 15 via the connecting conduit 28. This in turn causes the nozzle needle 10 to lift away from its seat so that the fuel is injected into the combustion chamber 14.

Consequently, the 3/2-way valve piston 34 is directly controlled by the piezoelectric actuator 43, with the valve piston 34 functioning as a force/movement transmitting element that acts on the ball element 35 provided as a sealing element. The 3/2-way directional control valve with the valve piston 34 and ball element 35 is embodied as almost pressure-balanced. This is achieved by virtue of the fact that the ball element 35 is continuously acted on by high pressure from the injector inlet, which affects the connecting conduit 33.

Figure 2:
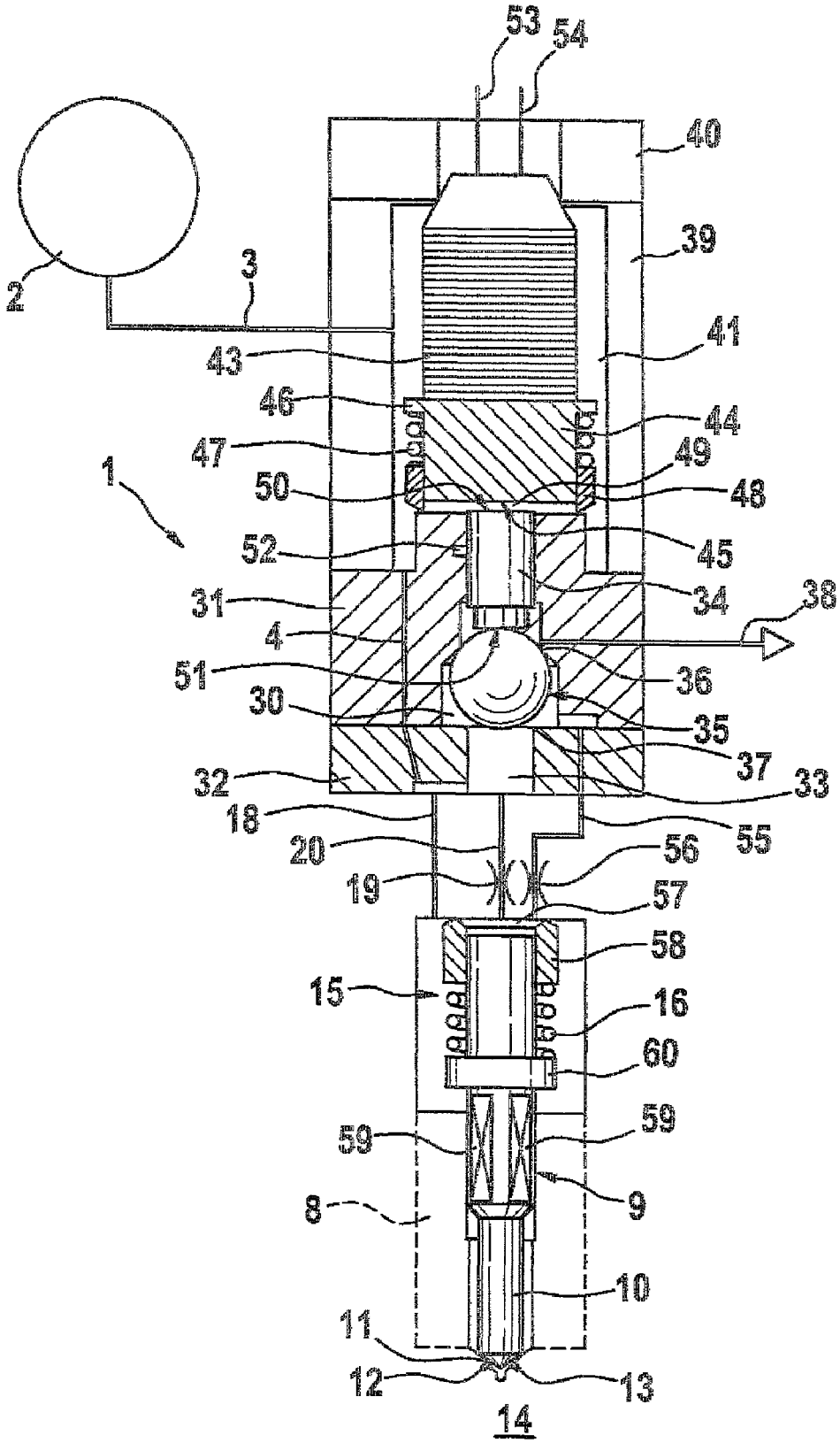
FIG. 2 shows another exemplary embodiment of a fuel injector according to FIG. 1, in which the device is embodied without a pressure booster.

FIG. 2 shows a fuel injector 1 without a pressure booster 5. The device shown in FIG. 2 includes the same design as the fuel injector shown in FIG. 1. Parts that are the same have been provided with the same reference numerals. In order to avoid repetition, the reader is referred to the preceding description of FIG. 1. The discussion below will center solely on the differences between the two embodiments.

In the fuel injector 1 shown in FIG. 2, the valve control chamber 30 communicates with the nozzle needle control chamber 57 via a connecting conduit 55 that includes a throttle 56. The nozzle needle control chamber 57 is situated inside a sealing sleeve 58 that is equipped with a biting edge. In addition, the nozzle needle control chamber 57 is delimited by an end surface of the nozzle needle 10. A collar 60 is embodied on the nozzle needle 10 and a nozzle spring 16 is situated between the collar 60 and the sealing sleeve 58. As a result, the biting edge of the sealing sleeve 58 is pressed against the injector housing. At the other end, the prestressing force of the nozzle spring 16 holds the tip of the nozzle needle 10 in contact with the associated nozzle needle seat. If the fuel injector shown in the deactivated position is activated, then the first sealing edge 36 shown in the closed position is opened and the second sealing edge 37 is closed. This produces a pressure increase in the hydraulic coupling chamber 49, thus causing the valve piston 34 and the ball element 35 to move downward. This opens the first sealing edge 36 and then the ball element 35 closes the second sealing edge, thus opening a connection between the valve control chamber 30 and the return 38. This relieves the pressure in the valve control chamber 30. This pressure relief also affects the nozzle needle control chamber 57 via the connecting conduit 55 so that because the nozzle needle 10 lifts away from its seat, fuel travels past flattened regions 59 in the nozzle needle 10 and is injected into the combustion chamber of the internal combustion engine.

The foregoing relates to the preferred exemplary embodiments of the invention, it being understood that other variants and embodiments thereof are possible within the spirit and scope of the invention, the latter being defined by the appended claims.

The invention claimed is:

1. A fuel injector for injecting fuel into a combustion chamber of an internal combustion engine, comprising:

an injector housing, a fuel inlet line that leads from a high-pressure fuel source and is hydraulically connectable to a pressure chamber, a 3/2-way directional control valve for the injection of fuel into the combustion chamber, the valve having a valve piston axially movable back and forth between a neutral position and an injection position, the valve piston having a first end surface that delimits a coupling chamber, which is hydraulically coupled to a piezoelectric actuator and activated by the piezoelectric actuator, the 3/2-way directional control valve further having a valve element in the form of a ball element that is connected to a second end surface of the valve piston and is movable in a valve control chamber against a first sealing edge in the neutral position and is movable against a second sealing edge in an injection position, the first and second sealing edges being embodied in a contour of the valve control chamber;

wherein in order to achieve a pressure-balanced switching, the first end surface of the valve piston and a partial surface on the ball element situated opposite to the first end surface, which partial surface is delimited by the second sealing edge, have effective surfaces of an approximate same size exposed to pressure from the high-pressure fuel source.

2. The fuel injector as recited in claim 1, wherein a diameter of the valve piston and a diameter at the first sealing edge have a ratio that permits the ball element to be pressed with a slight contact pressure against the first sealing edge in the neutral position.

3. The fuel injector as recited in claim 1, wherein the ball element is contained in an unguided fashion in the valve control chamber and is centered in a sealed fashion by a respective seat in the sealing edges.

4. The fuel injector as recited in claim 1, wherein the valve control chamber has a radially symmetrical inner contour so that the ball element produces an annular sealing contact against respective sealing edges.

5. The fuel injector as recited in claim 2, wherein the valve control chamber has a radially symmetrical inner contour so that the ball element produces an annular sealing contact against respective sealing edges.

6. The fuel injector as recited in claim 3, wherein the valve control chamber has a radially symmetrical inner contour so that the ball element produces an annular sealing contact against respective sealing edges.

7. The fuel injector as recited in claim 1, wherein the valve control chamber is pressurized from the high-pressure fuel source when the ball element produces a seal against the first sealing edge in the neutral position, and the pressure is relieved in the valve control chamber via a return line when the ball element produces a seal against the second sealing edge in the injection position.

8. The fuel injector as recited in claim 2, wherein the valve control chamber is pressurized from the high-pressure fuel source when the ball element produces a seal against the first sealing edge in the neutral position, and the pressure is relieved in the valve control chamber via a return line when the ball element produces a seal against the second sealing edge in the injection position.

9. The fuel injector as recited in claim 6, wherein the valve control chamber is pressurized from the high-pressure fuel source when the ball element produces a seal against the first sealing edge in the neutral position, and the pressure is relieved in the valve control chamber via a return line when the ball element produces a seal against the second sealing edge in the injection position.

10. The fuel injector as recited in claim 1, wherein a diameter of the valve piston is smaller than a diameter of the first sealing edge or a diameter of the second sealing edge is smaller than the diameter of the valve piston.

11. The fuel injector as recited in claim 2, wherein the diameter of the valve piston is smaller than the diameter of the first sealing edge or a diameter of the second sealing edge is smaller than the diameter of the valve piston.

12. The fuel injector as recited in claim 9, wherein a diameter of the valve piston is smaller than a diameter of the first sealing edge or a diameter of the second sealing edge is smaller than the diameter of the valve piston.

13. The fuel injector as recited in claim 1, wherein the ball element is composed of a metallic or ceramic material and is embodied as a standard roller bearing element.

14. The fuel injector as recited in claim 12, wherein the ball element is composed of a metallic or ceramic material and is embodied as a standard roller bearing element.

15. The fuel injector as recited in claim 1, wherein a geometrical shape of the valve piston is embodied as cylindrical base body.

16. The fuel injector as recited in claim 14, wherein a geometrical shape of the valve piston is embodied as cylindrical base body.

17. The fuel injector as recited in claim 1, wherein the hydraulic coupling chamber that is acted on by the pressure of the high-pressure fuel source and the hydraulic coupling chamber hydraulically couples the piezoelectric actuator to the first end surface of the valve piston.

18. The fuel injector as recited in claim 16, wherein the hydraulic coupling chamber that is acted on by the pressure of the high-pressure fuel source and the hydraulic coupling chamber hydraulically couples the piezoelectric actuator to the first end surface of the valve piston.

* * * * *